US010370853B2

(12) United States Patent
Grubka et al.

(10) Patent No.: US 10,370,853 B2
(45) Date of Patent: Aug. 6, 2019

(54) HIP AND RIDGE/STARTER SHINGLE COMBINATION

(71) Applicant: Owens Corning Intellectual Capital, LLC, Toledo, OH (US)

(72) Inventors: Lawrence J. Grubka, Westerville, OH (US); Rita Roberts, Oregon, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 15/492,312

(22) Filed: Apr. 20, 2017

(65) Prior Publication Data

US 2017/0306627 A1 Oct. 26, 2017

Related U.S. Application Data

(60) Provisional application No. 62/325,183, filed on Apr. 20, 2016.

(51) Int. Cl.

| | |
|---|---|
| ***E04D 1/00*** | (2006.01) |
| ***E04D 1/30*** | (2006.01) |
| ***E04D 1/20*** | (2006.01) |
| ***E04D 1/36*** | (2006.01) |
| ***E04D 1/26*** | (2006.01) |

(52) U.S. Cl.

CPC ..... *E04D 1/30* (2013.01); *E04D 1/20* (2013.01); *E04D 1/26* (2013.01); *E04D 1/36* (2013.01); *E04D 2001/301* (2013.01); *E04D 2001/304* (2013.01); *E04D 2001/305* (2013.01)

(58) Field of Classification Search

CPC ..... E04D 1/26; E04D 1/28; E04D 2001/305; E04D 5/00; B32B 5/30

See application file for complete search history.

(56) References Cited

U.S. PATENT DOCUMENTS

| | | | | | |
|---|---|---|---|---|---|
| RE15,439 | E | * | 8/1922 | Ferguson | E04D 1/26 52/559 |
| 1,474,380 | A | * | 11/1923 | Robinson | E04D 1/26 52/553 |
| 1,698,891 | A | * | 1/1929 | Overbury | E04D 1/26 29/412 |
| 1,799,293 | A | | 4/1931 | French | |

(Continued)

*Primary Examiner* — Gisele D Ford

(74) *Attorney, Agent, or Firm* — Calfee, Halter & Griswold LLP

(57) ABSTRACT

A shingle blank includes a substrate coated with asphalt, a headlap portion, a prime portion, a starter shingle separation line, and first and second ridge shingle separation lines. The headlap portion has a first sealant that extends along the width of the substrate, and the prime portion has a second sealant that extends along the width of the substrate. The starter shingle separation line extends along the width of the substrate and facilitates separation of the shingle blank into first and second starter shingles. The first starter shingle includes the first sealant and the second starter shingle includes the second sealant. The first and second ridge shingle separation lines extend along the height of the substrate from an upper edge of the substrate to a lower edge of the substrate and facilitates separation of the shingle blank into three ridge shingles. Each of the three ridge shingles includes a portion of the first sealant and a portion of the second sealant.

17 Claims, 4 Drawing Sheets

(56) References Cited

U.S. PATENT DOCUMENTS 1,957,826 A * 5/1934 Fradette ..... E04D 1/28 52/530
3,003,288 A 10/1961 Leibrook et al.
3,138,897 A 6/1964 McCorkle
3,247,631 A 4/1966 Lovness
3,667,184 A 6/1972 Merrill et al.
3,852,934 A 12/1974 Kirkhuff
3,943,677 A 3/1976 Carothers
4,068,027 A 1/1978 VanOrnam
4,079,561 A 3/1978 Valiee
4,185,436 A 1/1980 Valiee
4,218,857 A 8/1980 Valiee
4,404,783 A * 9/1983 Freiborg ..... E04D 1/205 52/518
4,434,589 A * 3/1984 Freiborg ..... E04D 1/20 52/276
4,439,955 A * 4/1984 Freiborg ..... E04D 1/20 52/276
4,559,267 A 12/1985 Freshwater et al.
4,567,079 A 1/1986 Canfield et al.
4,580,389 A 4/1986 Freiborg
4,588,634 A 5/1986 Pagen et al.
4,595,636 A 6/1986 Wiercinski et al.
4,600,635 A 7/1986 Wiercinski et al.
4,637,191 A 1/1987 Smith
4,672,790 A * 6/1987 Freiborg ..... E04D 1/26 52/521
4,778,831 A 10/1988 Kemper
4,835,929 A * 6/1989 Bondoc ..... E04D 1/30 52/276
4,923,913 A 5/1990 Chich et al.
5,065,553 A * 11/1991 Magid ..... E04D 13/1407 52/409
5,094,042 A * 3/1992 Freborg ..... E04D 1/20 52/57
5,247,771 A * 9/1993 Poplin ..... E04D 1/30 52/518
5,295,340 A * 3/1994 Collins ..... E04D 1/30 52/276
5,319,898 A * 6/1994 Freiborg ..... E04D 1/20 52/276
5,467,568 A * 11/1995 Sieling ..... E04D 1/26 52/276
5,471,801 A * 12/1995 Kupczyk ..... E04D 1/30 52/518
5,488,807 A 2/1996 Terrenzio et al.
D383,223 S * 9/1997 Sieling ..... D25/142
5,671,577 A 9/1997 Todd
5,676,597 A * 10/1997 Bettoli ..... E04D 1/30 454/365
5,799,459 A 9/1998 Covert
5,799,460 A 9/1998 Jensen
5,950,387 A * 9/1999 Stahl ..... E04D 1/26 52/555
6,070,384 A * 6/2000 Chich ..... E04D 1/30 52/518
6,125,602 A * 10/2000 Freiborg ..... E04D 1/265 52/198
6,199,338 B1 * 3/2001 Hudson, Jr. ..... E04D 1/26 52/105
6,351,913 B1 * 3/2002 Freiborg ..... E04D 1/30 52/276
6,360,506 B1 3/2002 Graae
6,403,711 B1 6/2002 Yang et al.
6,557,315 B2 5/2003 Tremblay
6,794,449 B2 9/2004 Fisher
6,874,289 B2 4/2005 Koch et al.
6,924,015 B2 8/2005 Zanchetta et al.
6,936,329 B2 8/2005 Kiik et al.
8,266,861 B2 9/2012 Koch et al.
8,567,601 B2 10/2013 Turek et al.
8,613,165 B2 12/2013 Bleil et al.
9,097,020 B2 8/2015 Grubka et al.
9,151,055 B2 10/2015 Grubka
2004/0009319 A1 1/2004 Zanchetta et al.
2004/0083672 A1 * 5/2004 Penner ..... E04D 1/30 52/518
2004/0111996 A1 6/2004 Heroneme
2004/0206012 A1 * 10/2004 Pressutti ..... E04D 1/30 52/57
2005/0055902 A1 * 3/2005 Pressutti ..... E04D 1/26 52/198
2007/0266665 A1 * 11/2007 Todd ..... E04D 1/20 52/518
2009/0282767 A1 * 11/2009 Grubka ..... E04D 1/20 52/518
2010/0178827 A1 7/2010 Thai et al.
2010/0212240 A1 * 8/2010 Grubka ..... E04D 1/20 52/309.1
2010/0212246 A1 * 8/2010 Grubka ..... B32B 37/24 52/540
2010/0236178 A1 9/2010 Loftus et al.
2010/0239807 A1 * 9/2010 Grubka ..... C08L 95/00 428/79
2010/0275534 A1 11/2010 Ruskin et al.
2011/0005158 A1 * 1/2011 Kailey ..... E04D 1/20 52/518
2011/0033685 A1 2/2011 Folkersen
2011/0126485 A1 * 6/2011 Bleil ..... E04D 1/20 52/528
2011/0151170 A1 * 6/2011 Grubka ..... E04D 1/20 428/43
2011/0214378 A1 * 9/2011 Grubka ..... E04D 1/30 52/553
2011/0283646 A1 11/2011 Vermilion et al.
2013/0177728 A1 * 7/2013 Grubka ..... E04D 1/20 428/43
2015/0047285 A1 * 2/2015 DeJarnette ..... E04D 1/20 52/560
2015/0240496 A1 * 8/2015 Grubka ..... E04D 1/20 428/40.3
2015/0326172 A1 11/2015 Koehler
2016/0186438 A1 * 6/2016 Montojo ..... E04D 1/30 52/518
2016/0340903 A1 * 11/2016 Folkersen ..... E04D 1/26

* cited by examiner

HIP AND RIDGE/STARTER SHINGLE COMBINATION

RELATED APPLICATIONS

The present application claims the benefit of U.S. Provisional Application Ser. No. 62/325,183, filed Apr. 20, 2016, titled HIP AND RIDGE/STARTER SHINGLE COMBINATION, the disclosure of which is incorporated herein by reference in its entirety.

BACKGROUND

Asphalt-based roofing materials, such as roofing shingles, roll roofing, and commercial roofing are installed on the roof of a building to provide protection from the elements. The roofing material may be constructed of a substrate such as a glass fiber mat or an organic felt, an asphalt coating on the substrate, and a surface layer of granules embedded in the asphalt coating.

Roofing materials are applied to a roof having various surfaces formed by roofing planes. The various surfaces and roofing planes include edges and intersections, such as, for example, hips, ridges, eaves, rakes, and valleys. During installation of roofing shingles on a roof, starter shingles and hip and ridge shingles are often used to cover the edges and intersections of a roof.

SUMMARY

The present application discloses a shingle blank, such as, for example, a shingle blank that can be separated into either starter shingles or hip and ridge shingles.

An exemplary shingle blank includes a substrate coated with asphalt, a headlap portion, a prime portion, a starter shingle separation line, and first and second ridge shingle separation lines. The headlap portion has a first sealant that extends along the width of the substrate, and the prime portion has a second sealant that extends along the width of the substrate. The starter shingle separation line extends along the width of the substrate, substantially bisects the substrate, and facilitates separation of the shingle blank into first and second starter shingles. The first starter shingle includes the first sealant and the second starter shingle includes the second sealant. The first and second ridge shingle separation lines extend along the height of the substrate from an upper edge of the substrate to a lower edge of the substrate, substantially divides the substrate into three equally sized parts, and facilitates separation of the shingle blank into three ridge shingles. Each of the three ridge shingles includes a portion of the first sealant and a portion of the second sealant.

Another exemplary shingle blank includes a substrate coated with asphalt, a headlap portion, a prime portion, a starter shingle separation line, and first and second ridge shingle separation lines. The headlap portion has a first sealant that extends along the width of the substrate, and the prime portion has a second sealant that extends along the width of the substrate. The starter shingle separation line extends along the width of the substrate and facilitates separation of the shingle blank into first and second starter shingles. The first starter shingle includes the first sealant and the second starter shingle includes the second sealant. The first and second ridge shingle separation lines extend along the height of the substrate from an upper edge of the substrate to a lower edge of the substrate and facilitates separation of the shingle blank into three ridge shingles. Each of the three ridge shingles includes a portion of the first sealant and a portion of the second sealant.

An exemplary shingle blank includes a substrate coated with asphalt, a headlap portion, a prime portion, a starter shingle perforated line, and first and second ridge shingle perforated lines. The headlap portion has a first sealant that extends along the width of the substrate, and the prime portion has a second sealant that extends along the width of the substrate. The starter shingle perforated line extends along the width of the substrate, substantially bisects the substrate, and facilitates separation of the shingle blank into first and second starter shingles. The first starter shingle includes the first sealant and the second starter shingle includes the second sealant. The first and second ridge shingle perforated lines extend along the height of the substrate from an upper edge of the substrate to a lower edge of the substrate, substantially divides the substrate into three equally sized parts, and facilitates separation of the shingle blank into three ridge shingles. Each of the three ridge shingles includes a portion of the first sealant and a portion of the second sealant. The first and second sealants are parallel to the starter shingle perforated line.

DETAILED DESCRIPTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Figure 1:
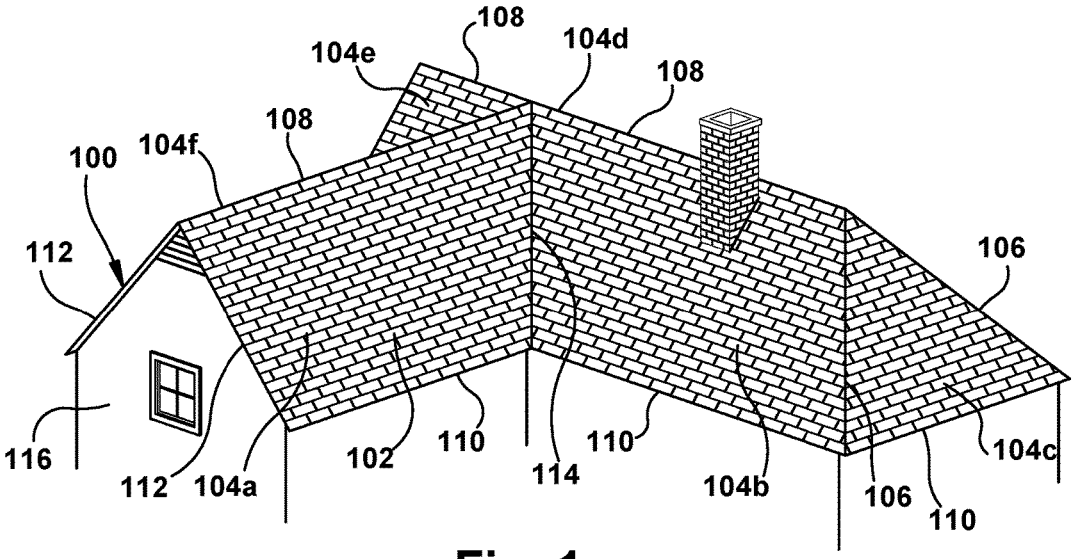
FIG. 1 is a perspective view of a building structure having roofing shingles installed on the roof.

The description and drawings disclose a shingle blank that can be separated into both starter shingles and hip and ridge shingles. With reference to FIG. 1, a building structure 100 is shown with a roofing system comprising shingles 102. While the building structure 100 illustrated in FIG. 1 is a residential home, it will be understood that the building structure 100 may be any type of structure, such as, for example, a garage, church, arena, or commercial building.

The building structure 100 has a plurality of roof planes 104*a*-104*f*. The term "roof plane" as used herein is defined as a plane or flat portion of the roof formed by an area of roof deck. Each of the roof planes 104*a*-104*f* has a slope. The term "slope" as used herein is defined as the degree of incline of the roof plane. While the roof planes 104*a*-104*f* shown in FIG. 1 have their respective illustrated slopes, it will be understood that the roof planes 104*a*-104*f* may have any suitable slope.

The roof of the building structure 100 may include any combination of hips 106, ridges 108, eaves 110, rakes 112, and valleys 114. The term "hip" as used herein is defined as the inclined external angle formed by the intersection of two sloping roof planes. For example, a hip 106 is illustrated at the intersection of roof planes 104*b* and 104*c*, and at the intersection of roof planes 104*c* and 104*d*. The term "ridge" as used herein is defined as the uppermost, horizontal external angle formed by the intersection of two sloping roof planes. For example, a ridge 108 is illustrated at the intersection of roof planes 104*a* and 104*f*, the intersection or roof planes 104*b* and 104*d*, and at the intersection of roof planes 104*d* and 104*e*. The term "eave" as used herein is defined as the horizontal, lower edge of a sloped roof. For example, an eave 110 is illustrated at the lower edge of roof planes 104*a*, 104*b*, and 104*c*. The term "rake" as used herein is defined as the inclined edge of a sloped roof over a wall from the eave to the ridge. For example, rakes 112 are illustrated at the inclined edge of sloped roof planes 104*a* and 104*f* over wall 116. The term "valley" as used herein is defined as the internal angle formed by the intersection of two sloping roof planes to provide water runoff. For example, a valley 114 is illustrated at the intersection of roof planes 104*a* and 104*b*.

The building structure is covered by a roofing system comprising a plurality of shingles 102. The shingles 102 are installed on the various roof planes 104*a*-104*f* in a generally horizontal course in which the shingles 102 overlap the shingles 102 of a preceding course. Any suitable design for a shingle 102 may be utilized. In covering a roof, different types of shingles may be used, such as, for example, conventional shingles (e.g., strip, three-tab, laminated), starter shingles, and hip and ridge shingles. Conventional shingles cover a majority of a roof plane 104*a*-104*f* However, other types of shingles provide preferred qualities at the intersections between roof planes 104*a*-104*f* and at the edges of roof planes 104*a*-104*f* For example, because shingles 102 overlap each other, a roof is covered with two layers of shingles 102, but the intersections between roof planes 104*a*-104*f* and edges of the roof planes 104*a*-104*f* may have only a single layer of shingles. In order to make the shingles consistent throughout the roof and to provide an additional layer of protection against outside elements at the edges and intersections, starter shingles and hip and ridge shingles may be utilized.

Starter shingles may be installed along the eaves 110 or any other area of a roof where a starter shingle is needed. After starter shingles are installed, a first course of conventional shingles is secured to and installed over the starter shingles. The first course of conventional shingles may be secured to the starter shingles by, for example, an adhesive, a sealant on the starter shingle and/or the conventional shingle, and/or fasteners (such as a nail). After the first course of conventional shingles are installed, subsequent courses of conventional shingles are installed by offsetting and overlaying the subsequent courses over a portion of each previously installed course of conventional shingles toward the ridge 108 of the roof.

Hip and ridge shingles may be installed along the hips 106, ridges 108, or any other area of a roof where a hip and ridge shingle is needed. Hip and ridge shingles are installed in a manner that is well known in the art. The hip and ridge shingles are installed after the conventional shingles are installed up to the hip 106 or ridge 108 on both planes 104*a*-104*f* that form the hip 106 or ridge 108. The first hip and ridge shingle is bent over the lowest point of the hip 106 or one end of the ridge 108 and fastened to the conventional shingles on each side of the hip 106 or ridge 108. Subsequent hip and ridge shingles partially overlay each previous hip and ridge shingle, are bent over the hip 106 or ridge 108 and the conventional shingles on either side of the hip 106 or ridge 108, and are fastened to a previous hip and ridge shingle and the hip 106 or ridge 108. Hip and ridge shingles may be fastened to previous hip and ridge shingles and/or the hip 106 or ridge 108 by an adhesive, a sealant, and/or fasteners (such as a nail).

FIGS. 2A-2D are illustrations of a shingle blank 200 that can be separated into starter shingles or hip and ridge shingles. The shingle blank 200 is a substrate 201 coated with asphalt that includes a headlap portion 202, a prime portion 204, a starter shingle separation line 210, and a first and second ridge shingle separation line 212. The width W of the substrate 201 may be, for example, between about 36 inches and about 40 inches. The height H of the substrate 201 may be, for example, between about 11 inches and about 16 inches. In an exemplary embodiment, the height HH of the headlap portion 202 and the height PH of the prime portion 204 are substantially the same. In another embodiment, the height HH of the headlap portion 202 and the height PH of the prime portion 204 are different. For example, the height HE of the headlap portion 202 may be between about 6 inches and about 8 inches, and the height PH of the prime portion 204 may be between about 5 inches and about 6 inches, but at least one inch less than the height HE of the headlap portion 202. In certain embodiments, both the headlap portion 202 and the prime portion 204 are embedded with granules. Additionally, in some embodiments, the granules on the prime portion 204 of the shingle blank 200 are more aesthetically pleasing than the granules on the headlap portion 202 of the shingle blank 200.

The headlap portion 202 has a first sealant 206 extending along the width W of the substrate 201, and the prime portion has a second sealant 208 extending along the width W of the substrate 201. In the illustrated embodiment, the first sealant 206 and the second sealant 208 are disposed on the top surface of the substrate 201. In another embodiment, the first sealant 206 and the second sealant 208 may be disposed on the bottom surface of the substrate 201. In yet another embodiment, one of the first sealant 206 and the second sealant 208 may be disposed on the top surface of the substrate 201, and the other of the first sealant 206 and the second sealant 208 may be disposed on the bottom surface of the substrate 201.

The starter shingle separation line 210 extends along the width W of the substrate 201, substantially bisects the substrate 201, and facilitates separation of the substrate 201 into a first starter shingle 214 and a second starter shingle 216. The starter shingle separation line 210 is a line of weakness that may be in the form of a perforated line, a score, a mat cut with the asphalt holding the shingle blank 200 together, or any other form that facilitates separation of the shingle blank 200 into a first starter shingle 214 and a second starter shingle 216. The first starter shingle 214 includes the first sealant 206, and the second starter shingle 216 includes the second sealant 208. The first starter shingle 214 may include the headlap portion 202 of the shingle blank 200, and the second starter shingle 216 may include the prime portion 204 of the shingle blank 200, or vice versa. In certain embodiments, either the first starter shingle 214 or the second starter shingle 216 may include the entire prime portion 204 and a portion of the headlap portion 202. In an exemplary embodiment, the entire headlap portion 202 may be on one of the first starter shingle 214 and the second starter shingle 216.

The first and second ridge shingle separation lines 212 extend along a height H of the substrate 201 from an upper edge 218 of the substrate 201 to a lower edge 220 of the substrate 201. The first and second ridge shingle separation lines 212 divide the substrate 201 into three equally sized pieces and facilitate separation of the substrate 201 into three ridge shingles 222. The first and second ridge shingle separation lines 212 are lines of weakness that may be in the form of a perforated line, a score, a mat cut with the asphalt holding the shingle blank 200 together, or any other form that facilitates separation of the shingle blank 200 into three ridge shingles 222. After the substrate 201 is separated along the first and second ridge shingle separation lines 212, each of the ridge shingles 222 includes part of the headlap portion 202, part of the prime portion 204, a portion of the first sealant 206, and a portion of the second sealant 208.

Figure 2A:
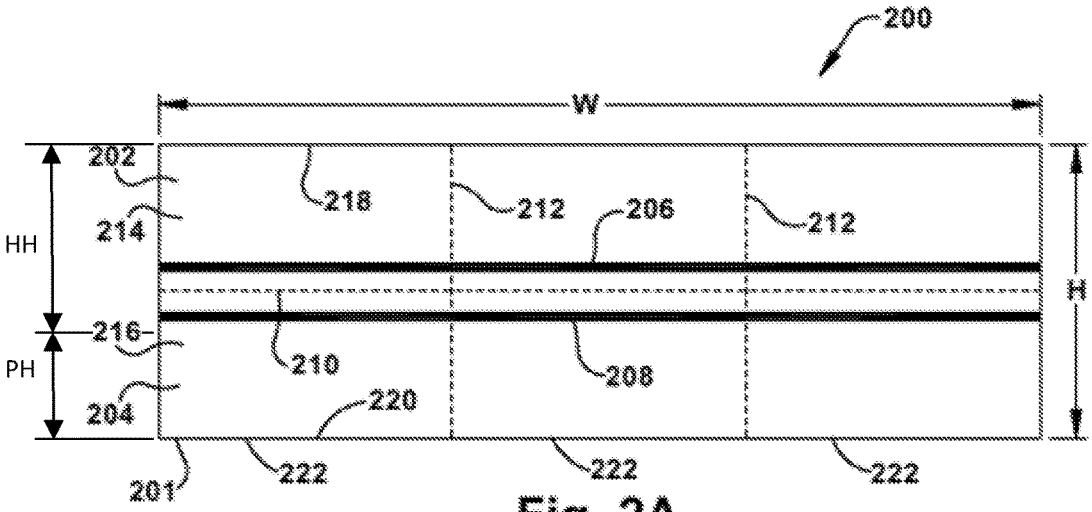
FIGS. 2A-2D are illustrations of exemplary embodiments of shingle blanks that may be separated into either starter shingles or hip and ridge shingles.
Figure 2B:
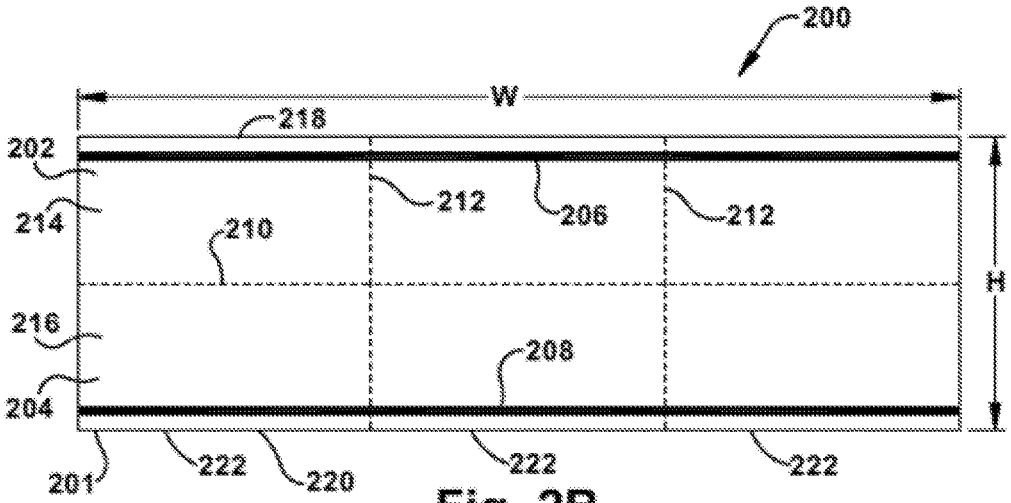
Figure 2C:
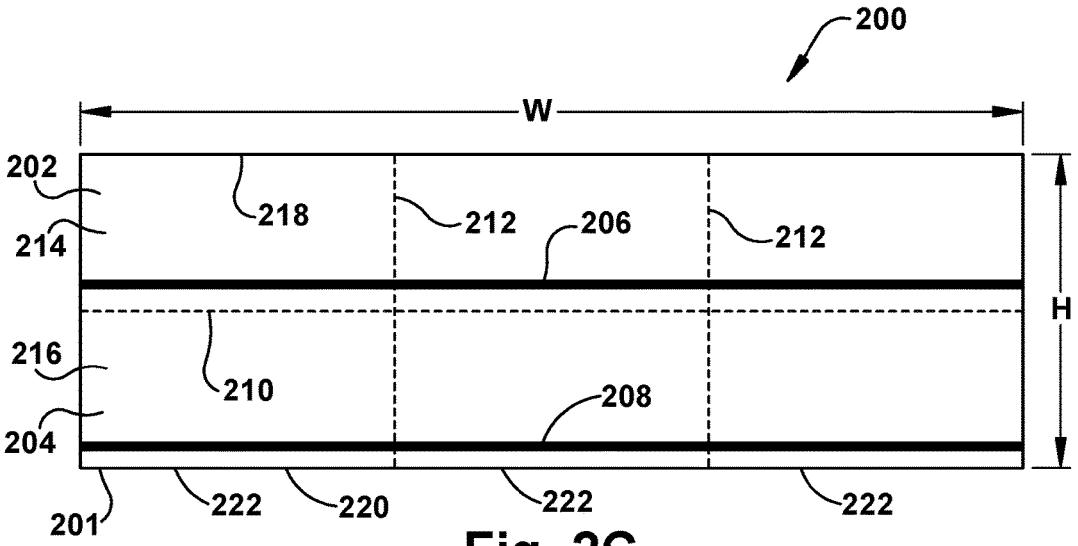
Figure 2D:
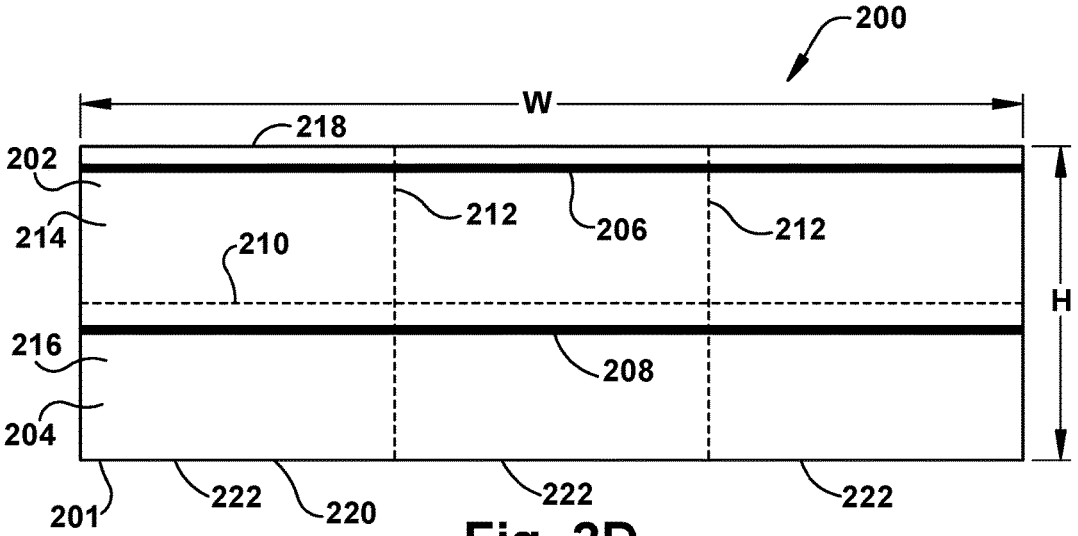

In certain embodiments, the first sealant 206, the second sealant 208, or both sealants 206, 208 are parallel to the starter shingle separation line 210. Referring to FIG. 2A, both the first sealant 206 and the second sealant 208 may be located proximate to the starter shingle separation line 210. Referring to FIG. 2B, the first sealant 206 may be located proximate to the upper edge 218 of the substrate 201, and the second sealant 208 may be located proximate to the lower edge 220 of substrate 201. Referring to FIG. 2C, the first sealant 206 may be located proximate to the starter shingle separation line 210, and the second sealant 208 may be located proximate to the lower edge 220 of the substrate 201. Referring to FIG. 2D, the first sealant 206 may be located proximate to the upper edge 218 of the substrate 201, and the second sealant 206 may be located proximate to the starter shingle separation line 210.

Figure 3A:
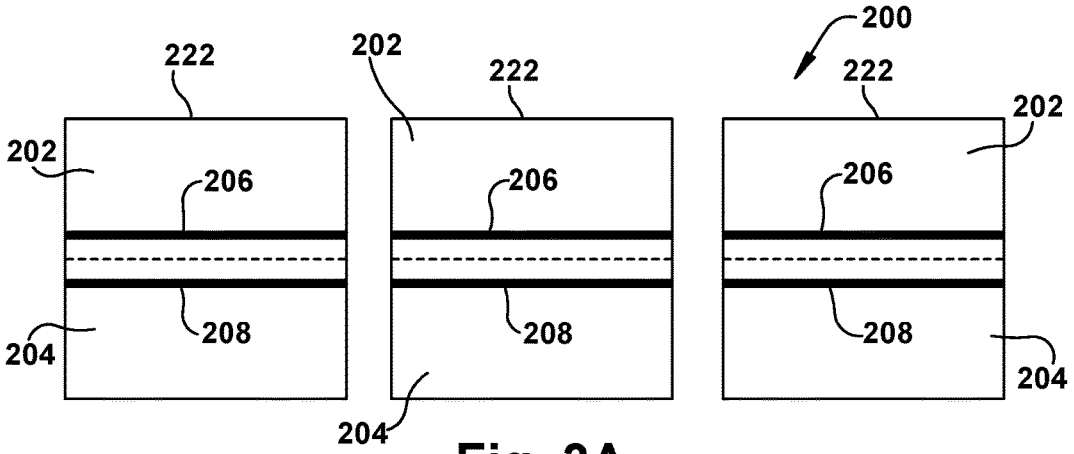
FIG. 3A is an illustration of the exemplary shingle blank of FIG. 2A after the shingle blank is separated into hip and ridge shingles.

FIG. 3A illustrates the shingle blank 200 after being separated into hip and ridge shingles 222. Each of the ridge shingles 222 includes part of the headlap portion 202, part of the prime portion 204, a portion of the first sealant 206, and a portion of the second sealant 208. In certain embodiments, both the headlap portion 202 and the prime portion 204 are embedded with granules. Additionally, in some embodiments, the granules on the prime portion 204 of the shingle blank 200 are more aesthetically pleasing than the granules on the headlap portion 202 of the shingle blank 200. During installation, the headlap portion 202 of the hip and ridge shingles 222 may be covered by an overlapping roofing shingle, and the prime portion 204 of the hip and ridge shingles 222 remains exposed.

Figure 3B:
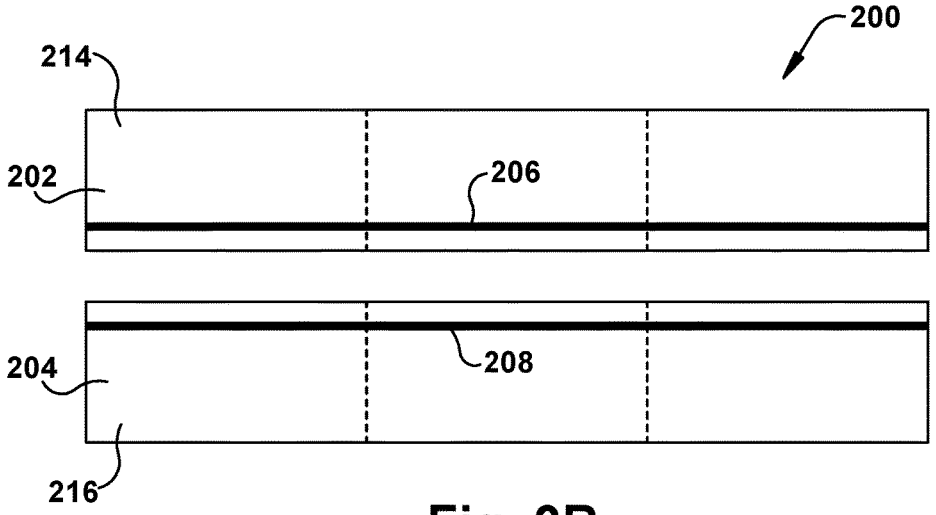
FIG. 3B is an illustration of the exemplary shingle blank of FIG. 2A after the shingle blank is separated into starter shingles.

FIG. 3B illustrates the shingle blank after being separated into a first starter shingle 214 and a second starter shingle 216. The first starter shingle 214 may include the headlap portion 202 of the substrate 201, and the second starter shingle 216 may include the prime portion 204 of the substrate 201, or vice versa. In certain embodiments, either the first starter shingle 214 or the second starter shingle 216 may include the entire prime portion 204 and a portion of the headlap portion 202. In an exemplary embodiment, the entire headlap portion 202 may be on one of the first starter shingle 214 and the second starter shingle 216. During installation, both the first starter shingle 214 and the second starter shingle 216 are covered by an overlapping roofing shingle.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof.

Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A shingle blank comprising:

a substrate coated with asphalt;

a headlap portion comprising a first sealant extending along a width of the substrate;

a prime portion comprising a second sealant extending along the width of the substrate;

a starter shingle perforation line extending along the width of the substrate and substantially bisecting the substrate, wherein the starter shingle perforation line comprises perforations that extend entirely through the substrate;

wherein the starter shingle perforation line is configured to facilitate separation of the shingle blank into first and second starter shingles;

wherein the first starter shingle includes the first sealant and the second starter shingle includes the second sealant;

first and second ridge shingle perforation lines extending along a height of the substrate from an uppermost edge of the substrate to a lowermost edge of the substrate and substantially dividing the substrate into three equally sized pieces, wherein the first and second ridge shingle perforation lines comprise perforations that extend entirely through the substrate;

wherein the first and second ridge shingle perforation lines are configured to facilitate separation of the shingle blank into three ridge shingles;

wherein the first and second ridge shingle perforation lines extend across the starter shingle perforation line and are substantially perpendicular to the starter shingle perforation line;

wherein each of the three ridge shingles include a portion of the first sealant and a portion of the second sealant;

wherein each of the three ridge shingles include a portion of the starter shingle perforation line;

wherein the first and second starter shingles include a portion of the first and second ridge single perforation lines;

wherein each of the three ridge shingles are rectangular, such that the prime portion of each of the three ridge shingles has a first width that extends along the width of the substrate, and the headlap portion of each of the three shingles has a second width that extends along the width of the substrate, and wherein the first width is equal to the second width.

2. The shingle blank of claim 1, wherein the headlap portion is disposed entirely on one side of the starter shingle perforation line.

3. The shingle blank of claim 1, wherein a height of the prime portion is less than a height of the headlap portion, such that one of the starter shingles includes a portion of the headlap portion and all of the prime portion.

4. The shingle blank of claim 1, wherein the first and second sealants are parallel to the starter shingle perforation line.

5. The shingle blank of claim 1, wherein both the first sealant and the second sealant are disposed proximate to the starter shingle perforation line.

6. The shingle blank of claim 1, wherein the first sealant is disposed proximate to the upper edge of the substrate, and wherein the second sealant is disposed proximate to the lower edge of the substrate.

7. The shingle blank of claim 1, wherein one of the first sealant and the second sealant is disposed proximate to the starter shingle perforation line, and wherein the other of the first sealant and the second sealant is disposed proximate to one of the upper edge and the lower edge of the substrate.

8. The shingle blank of claim 1, wherein the width of the substrate is between 36 inches and 40 inches.

9. The shingle blank of claim 1, wherein the height of the substrate is between 11 inches and 16 inches.

10. A shingle blank comprising:

a substrate coated with asphalt;

a headlap portion comprising a first sealant extending along a width of the substrate;

a prime portion comprising a second sealant extending along the width of the substrate;

a starter shingle perforation line extending along the width of the substrate, wherein the starter shingle perforation line comprises perforations that extend entirely through the substrate;

wherein the starter shingle perforation line is configured to facilitate separation of the shingle blank into first and second starter shingles;

wherein the first starter shingle includes the first sealant and the second starter shingle includes the second sealant;

first and second ridge shingle perforation lines extending along a height of the substrate from an uppermost edge of the substrate to a lowermost edge of the substrate, wherein the first and second ridge shingle perforation lines comprise perforations that extend entirely through the substrate;

wherein the first and second ridge shingle perforation lines are configured to allow facilitate separation of the shingle blank into three ridge shingles;

wherein the first sealant and the second sealant extend over the first and second ridge shingle separation lines;

wherein each of the three ridge shingles include a portion of the first sealant and a portion of the second sealant;

wherein each of the three ridge shingles are rectangular, such that the prime portion of each of the three ridge shingles has a first width that extends along the width of the substrate, and the headlap portion of each of the three shingles has a second width that extends along the width of the substrate, and wherein the first width is equal to the second width.

11. The shingle blank of claim 10, wherein the headlap portion is disposed entirely on one side of the starter shingle perforation line.

12. The shingle blank of claim 10, wherein the first and second sealants are parallel to the starter shingle perforation line.

13. The shingle blank of claim 10, wherein the starter shingle perforation line and the first and second ridge shingle perforation lines comprise perforated lines.

14. The shingle blank of claim 10, wherein both the first sealant and the second sealant are disposed proximate to the starter shingle perforation line.

15. The shingle blank of claim 10, wherein the width of the substrate is between 36 inches and 40 inches.

16. The shingle blank of claim 10, wherein the height of the substrate is between 11 inches and 16 inches.

17. A shingle blank comprising:

a substrate coated with asphalt;

a headlap portion comprising a first sealant extending along a width of the substrate;

a prime portion comprising a second sealant extending along the width of the substrate;

a starter shingle perforation line extending along the width of the substrate and substantially bisecting the substrate, wherein the starter shingle perforation line comprises perforations that extend entirely through the substrate;

wherein the starter shingle perforation line is configured to facilitate separation of the shingle blank into first and second starter shingles;

wherein the first starter shingle includes the first sealant and the second starter shingle includes the second sealant;

first and second ridge shingle perforation lines extending along a height of the substrate from an uppermost edge of the substrate to a lowermost edge of the substrate and substantially dividing the substrate into three equally sized pieces, wherein the first and second ridge shingle perforation lines comprise perforations that extend entirely through the substrate;

wherein the first and second ridge shingle perforation lines are configured to facilitate separation of the shingle blank into three ridge shingles, wherein each of the three ridge shingles are rectangular, such that the prime portion of each of the three ridge shingles has a first width that extends along the width of the substrate, and the headlap portion of each of the three shingles has a second width that extends along the width of the substrate, and wherein the first width is equal to the second width;

wherein the first and second ridge shingle perforation lines extend across the starter shingle perforation line and are substantially perpendicular to the starter shingle perforation line;

wherein the first sealant and the second sealant extend over the first and second ridge shingle perforation lines;

wherein each of the three ridge shingles include a portion of the first sealant and a portion of the second sealant;

wherein each of the three ridge shingles include a portion of the starter shingle perforation line;

wherein the first and second starter shingles include a portion of the first and second ridge shingle perforation lines; and wherein the first and second sealants are parallel to the starter shingle perforated line.

* * * * *